US006662153B2

(12) United States Patent
Kim et al.

(10) Patent No.: US 6,662,153 B2
(45) Date of Patent: Dec. 9, 2003

(54) SPEECH CODING SYSTEM AND METHOD USING TIME-SEPARATED CODING ALGORITHM

(75) Inventors: Hyoung Jung Kim, Taejon (KR); In Sung Lee, Taejon (KR); Jong Hark Kim, Chungju (KR); Man Ho Park, Taejon (KR); Byung Sik Yoon, Taejon (KR); Song In Choi, Taejon (KR); Dae Sik Kim, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 361 days.

(21) Appl. No.: 09/769,068

(22) Filed: Jan. 24, 2001

(65) Prior Publication Data

US 2002/0052737 A1 May 2, 2002

(30) Foreign Application Priority Data

Sep. 19, 2000 (KR) ..... 2000-54959

(51) Int. Cl.[7] ..... G10L 11/06; G10L 19/04; G10L 19/08

(52) U.S. Cl. ..... 704/214; 704/216; 704/219

(58) Field of Search ..... 704/214, 200, 704/230, 267, 268, 208, 203, 205, 216, 219

(56) References Cited

U.S. PATENT DOCUMENTS

| | | | | |
|---|---|---|---|---|
| 4,310,721 A | * | 1/1982 | Manley et al. | 704/203 |
| 5,463,715 A | * | 10/1995 | Gagnon | 704/267 |
| 5,774,837 A | * | 6/1998 | Yeldener et al. | 704/208 |
| 5,890,108 A | | 3/1999 | Yeldener | 704/208 |
| 6,131,084 A | * | 10/2000 | Hardwick | 704/230 |
| 6,233,550 B1 | * | 5/2001 | Gersho et al. | 704/208 |
| 6,253,182 B1 | * | 6/2001 | Acero | 704/268 |
| 6,385,570 B1 | * | 5/2002 | Kim | 704/200 |
| 6,434,519 B1 | * | 8/2002 | Manjunath et al. | 704/205 |

FOREIGN PATENT DOCUMENTS

JP 07-066897 * 3/1995 ..... H04M/11/00

OTHER PUBLICATIONS

Ghitza ("Robustness Against Noise: The Role Of Timing–Synchrony Measurement", IEEE International Conference on Acoustics, Speech, and Signal Processing, pp. 2372–2375, vol. 12, Apr. 1987).*

Jensen et al., "Exponential Sinusoidal Modeling of Transitional Speech Segments," *Proceedings of the 1999 IEEE International Conference on Acoustics, Speech and Signal Processing*, vol. 1, pp. 473–476, 1999.

Li and Cuperman, "Enhanced Harmonic Coding of Speech with Frequency Domain Transition Modeling," *Proceedings of the 1998 IEEE International Conference on Acoustics, Speech and Signal Processing*, vol. 2: pp. 581–584, 1998.

Sohn and Sung, "A Low Resolution Pulse Position Coding Method for Improved Excitation Modeling of Speech Transition," *Proceedings of the 1999 IEEE International Conference on Acoustics, Speech and Signal Processing*, vol. 1, pp. 265–268, 1999.

* cited by examiner

*Primary Examiner*—Richemond Dorvil
*Assistant Examiner*—Daniel Nolan
(74) *Attorney, Agent, or Firm*—Seed IP Law Group PLLC

(57) ABSTRACT

A time-separated speech coder that codes a transitional signal of voiced/unvoiced sound through harmonic speech coding, the coder including a transitional excitation signal analyzer/synthesizer for coding the transitional signal by extracting the harmonic model parameters of both transitional analyzers after detecting a transitional point and generating sinusoidal waveforms according to a variable transitional point separating both transitional analyzers. By the transitional point at which energy varies abruptly and the time-separated coding based on the transitional point, more improved speech quality than in the general harmonic speech coder can be obtained using the time-separated speech coder by increasing the representation capability of the transitional signal with large energy variation, after adapting it to the variable transitional point.

10 Claims, 6 Drawing Sheets

SPEECH CODING SYSTEM AND METHOD USING TIME-SEPARATED CODING ALGORITHM

TECHNICAL FIELD

The present invention relates to a speech coding and more particularly to the time-separated speech coder that codes by separating the transitional analyzer after detecting the transitional point of the transitional analyzer in order to obtain more improved speech quality of the transitional analyzer which is not represented well as harmonic speech coding model out of low rate speech coding methods.

BACKGROUND OF THE INVENTION

Generally there is transitional analyzer in which unvoiced sound is connected to voiced sound or vice versa. As this transitional analyzer has more information about time domain such as abrupt energy variation and pitch period's variation, in the case of coding method by the harmonic model, there are disadvantages including difficulty of effective coding and occurrence of mechanical synthesis sound.

Concretely there is the transitional analyzer in which voiced and unvoiced sound are together and the transitional analyzer is in the time at which generally voiced sound drift to unvoiced sound or vice versa.

By using linear interpolation overlap/add synthesis method of the harmonic coder in this section, there are disadvantages like the distortion of the pitch and the gain of waveform in the portion in which energy varies not continuously but abruptly. Therefore, the method is required in the transitional analyzer that codes separately after detecting the time at which energy varies abruptly.

Recently the research about coding method of said transitional analyzer has been more important research field according as increase of researches of low rate coding methods. As there is not effective representation technology for the transitional analyzer of the low rate model until now, more appropriate model and coding method are required.

Recently, the research about coding method of said transitional analyzer can be divided into the analysis method in frequency domain and that in time domain.

First, in the analysis method in frequency domain, there is a method for representing the mixed signal of voiced/unvoiced sound using the probability value after obtaining the probability value of the voiced sound by analyzing the spectral of the speech. The U.S. Pat. No. 5,890,108 of Yeldener and Suat, titled "Low Bit Rate Speech Coding System And Method Using Voicing Probability Determination", describes the contents that synthesizes the mixed signal after analyzing the modified linear predictive parameter of the unvoiced sound and the spectral of the voiced sound according to the degree of the probability value of the voiced sound which is computed by the parameter and pitch extracted from the spectrum of the inputted speech signal. However, this method has a disadvantage of not capable of representing the time information like the time local pulse.

Next, there are methods using sinusoidal wave congregation set which expands the existing sinusoidal wave modeling, for example, the publication issued by Chunyan Li and Vladimir Cuperman in ICASSP 98 volume 2 581–584 pages on May. 1998, entitled "Enhanced Harmonic Coding Of Speech With Frequency Domain Transition Modeling" used duplicate harmonic model using several pulse positions, magnitude and phase parameter in order to represent irregular pulse of the transitional analyzer and described the technology for computing each parameter by close loop optimized method. The coding method according to the analysis method in time domain makes total computation to be complicated by applying the harmonic model for several pulse train and by duplicating it and makes effective coding to be difficult without damaging real speech signal.

SUMMARY OF THE INVENTION

According to a first aspect of the present invention, a time-separated speech coder for coding the transitional signal of voiced/unvoiced sound through harmonic speech coding is provided. The time-separated speech coder includes an excitation signal's transitional analyzer that includes a transitional point detector for detecting a transitional point to notify the transitional analyzer of the transitional signal, a harmonic excitation signal analyzer for extracting the harmonic model parameter of the detected transitional analyzer and a harmonic excitation signal synthesizer for adding a harmonic model parameter.

Preferably, the harmonic excitation signal analyzer includes a window for extracting the harmonic model parameter of each block by applying the Time Warp Hamming (TWH) window corresponding to a central point of each block after dividing the Linear Prediction Coefficient (LPC) residual signal, which is one of the inputted signals within the transitional analyzer centering the detected transitional point.

According to a second aspect of the present invention, a time-separated speech coding method for coding the transitional signal of voiced/unvoiced sound through harmonic speech coding includes detecting the transitional point of the transitional signals, extracting a harmonic model parameter from each block by applying the TWH window to the central point of left/right block after dividing an LPC residue signal out of inputted signals centering the transitional point, and adding the harmonic model parameter.

BRIEF DESCRIPTION OF THE DRAWINGS

The embodiments of the present invention will be explained with reference to the accompanying drawings, in which.

DETAILED DESCRIPTION OF THE INVENTION

Referring to accompanied drawings, other advantages and effects of the present invention can be more clearly understood through desirably executable examples of coders being explained.

The coder according to the present invention codes each of them by detecting abrupt energy variation in said transitional analyzer and then dividing them into not frequency section but time section, concretely two time sections.

The transitional analyzer which is separating said transitional analyzer uses LPC (Linear Prediction Coefficient) residual signal as input and makes possible to providing more improved speech quality to the speech coder of harmonic model by using open loop pitch and speech signal as inputs in the detection of the transitional point in which energies are abruptly varied.

Figure 1:
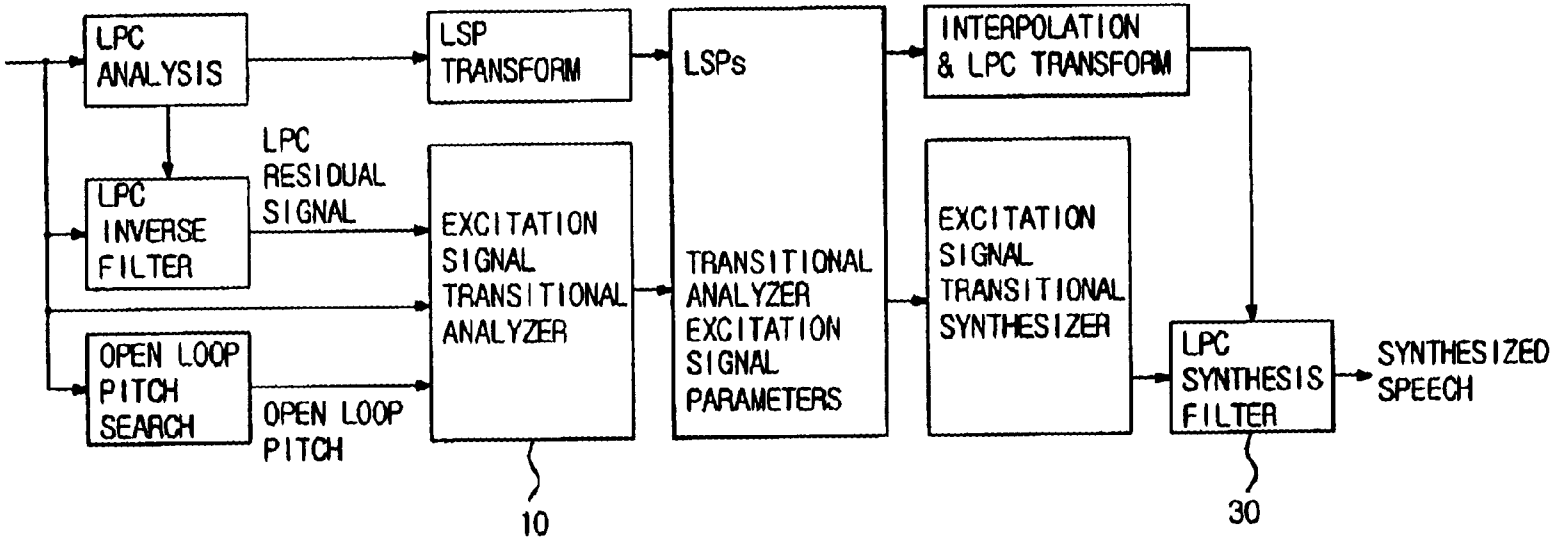
FIG. 1 is a drawing illustrating total block diagram of a time-separated coder for the transitional analyzer according to the present invention.

FIG. 1 is total block diagram illustrating a time-separated coder for the transitional analyzer according to the present invention.

Figure 2:
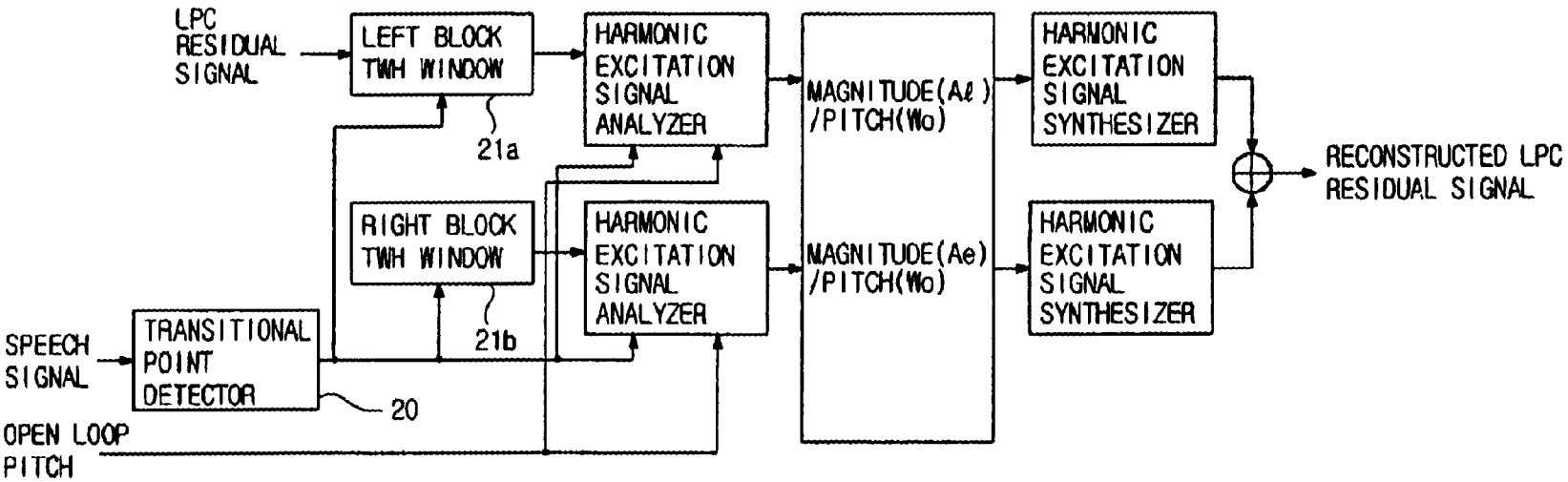
FIG. 2 is a drawing illustrating more concrete block diagram for the transitional analyzer analysis synthesis according to the present invention.

FIG. 2 illustrates a more concrete block diagram for the transitional analyzer analysis synthesis according to the present invention.

By referring to FIG. 1, not only input signals but also open loop pitch value and LPC residual signal which is LPC analyzed are inputted to the excitation signal transitional analyzer 10. The residual excitation signal parameters extracted through said analyzer 10 are LSP transformed and then interpolated and synthesized with the LPC transformed signal in the LPC synthesis filter 30 and outputted.

By briefly describing the transitional analyzer analysis synthesis illustrated in FIG. 2, centering the transitional point detected by the transitional point detector 20, the LPC residual signal is divided and TWH (Time Warping Hamming) window 21*a* and 21*b* fitting to the center point of left/right block is laid and then the harmonic model parameters of each window are separately extracted.

Figure 3:
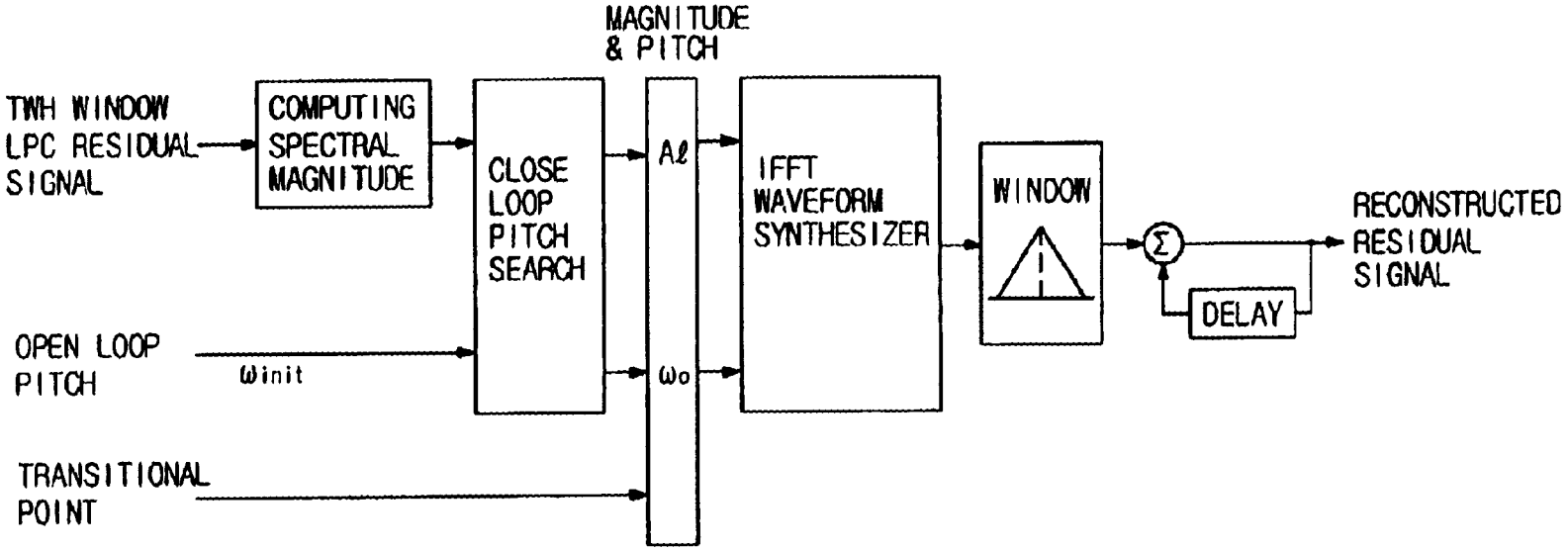
FIG. 3 is a drawing illustrating the transitional analyzer harmonic analysis synthesis procedure.
Figure 4A:
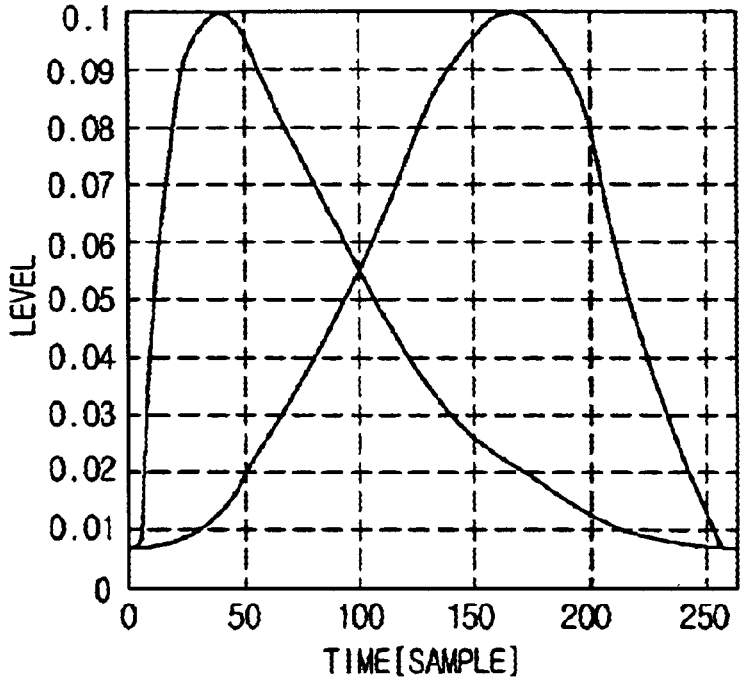
FIGS. 4A–4D are drawings illustrating the shape of the TWH window using the central values of two blocks according to the position value of each transitional point.
Figure 4B:
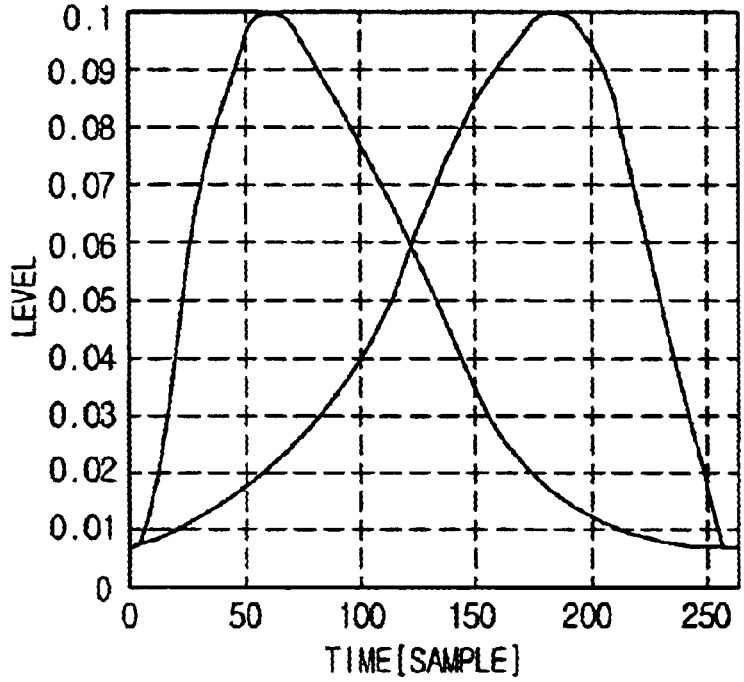
Figure 4C:
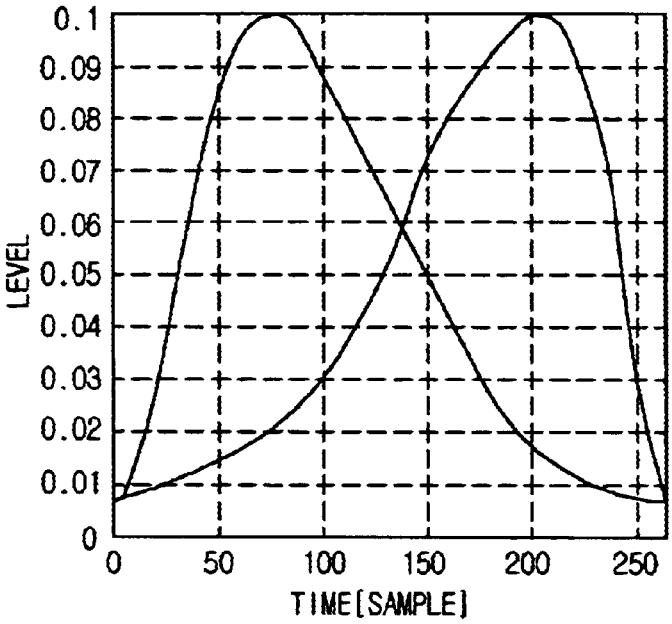
Figure 4D:
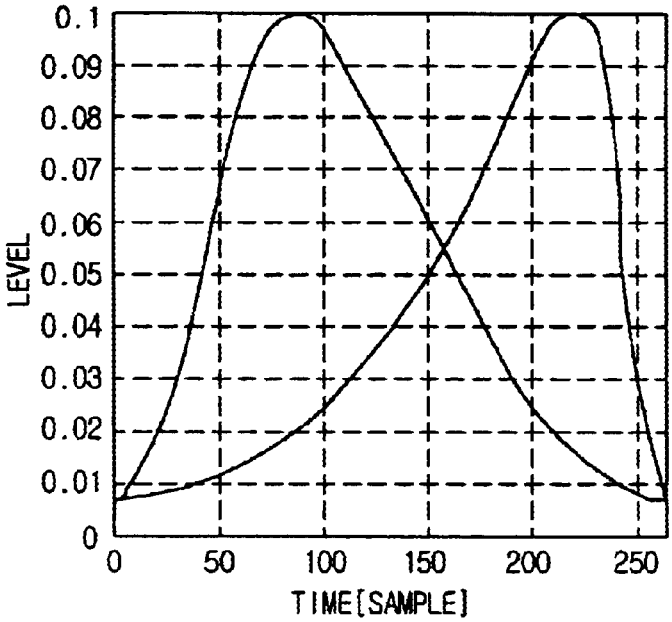

The transitional analyzer harmonic analysis synthesis procedure is illustrated in FIG. 3.

The detailed procedure for extracting said harmonic model parameter and the analysis and synthesis method in the transitional analyzer is described in turn with equations.

The object of the harmonic model is LPC residual signal and finally extracted parameters are spectrum magnitudes and close loop pitch value $\omega_0$.

The representation of said excitation signal, namely the LPC residual signal, have detailed coding procedure on the basis of sinusoidal waveform model as following Equation 1.

$$s(n) = \sum_{l=1}^{L} A_l \cos(\omega_l n + \varphi_l) \tag{1}$$

Where, $A_l$ and $\psi_l$ represent magnitude and phase of sinusoidal wave component with frequency $\omega_l$ respectively, and L is the number of sinusoidal waveforms.

As the harmonic portion includes the information of most of speech signal information, the excitation signal of voiced sound section can be approximated using appropriate spectrum fundamental model.

Following Equation 2 represents the approximated model with linear phase synthesis.

$$s^k(n) = \sum_{l=1}^{L_k} A_l^k \cos(l\omega_0^k n + \varphi^k(l, \omega_0^k, n) + \Phi_l^k) \tag{2}$$

Where, k and $L_k$ represent frame number and the number of harmonics per frame respectively, $\omega_0$ represents the angular frequency of the pitch, and $\Phi^k_l$ represents the discrete phase of the kth frame and the lth harmonic.

The $A^k_l$ representing the magnitude of the kth frame and $\omega_0$ are information transmitted to the coder and by making the value applying 256 DFT of the Hamming Window to be reference model, the spectral and pitch parameter value making the value of following Equation 3 to be minimum is determined by close loop searching method.

$$e_l = \sum_{l=a_l}^{b_l} (|X(i)| - |A_l||B(i)|)^2 \tag{3}$$

$$A_l = \frac{\sum_{j=a_l}^{b_l} |X(j)||B(j)|}{\sum_{j=a_l}^{b_l} |B(j)|^2}$$

Where, X(j) and B(j) represent the DFT value of the original LPC residual signal and the DFT value of the 256-point hamming window respectively, and $a_m$ and $b_m$ represent the DFT indexes of the start and end of the mth harmonic. Also, W(i) and B(i) mean the spectrum of the original signal and spectral reference model respectively.

The analyzed parameters are used for synthesis and the phase synthesis uses general linear phase synthesis method like following Equation 4.

$$\varphi^k(l, \omega_0, n) = \varphi^{k-1}(l, \omega_0^{k-1}, n) + \frac{l(\omega_0^{k-1} + \omega_0^k)}{2} n \tag{4}$$

The linear phase is obtained by linearly interpolating the angular frequency of the pitch according to the time of the previous frame and the present frame. Generally, the hearing sense system of man is understood to be non-sensitive to the linear phase while phase continuity is preserved and to permit inaccurate or totally different discrete phase. These perceptible characteristics of a man are important condition for the continuity of the harmonic model in low rate coding method. Therefore, the synthesis phase can substitute the measured phase.

These harmonic synthesis models can be implemented by the existing IFFT (Inverse Fast Fourier Transform) synthesis method and the procedure is as follows.

In order to synthesize the reference waveform, in spectral parameter, the harmonic magnitudes are extracted through reverse quantization. The phase information corresponding to each harmonic magnitude is made by using the linear phase synthesis method, and then the reference waveform is made through 128-point IFFT. As the reference waveform does not include the pitch information, reformed to the circular format and then final excitation signal is obtained by sampling after interpolating to the over-sampling ratio obtained from the pitch period considering the pitch variation.

Figure 5:
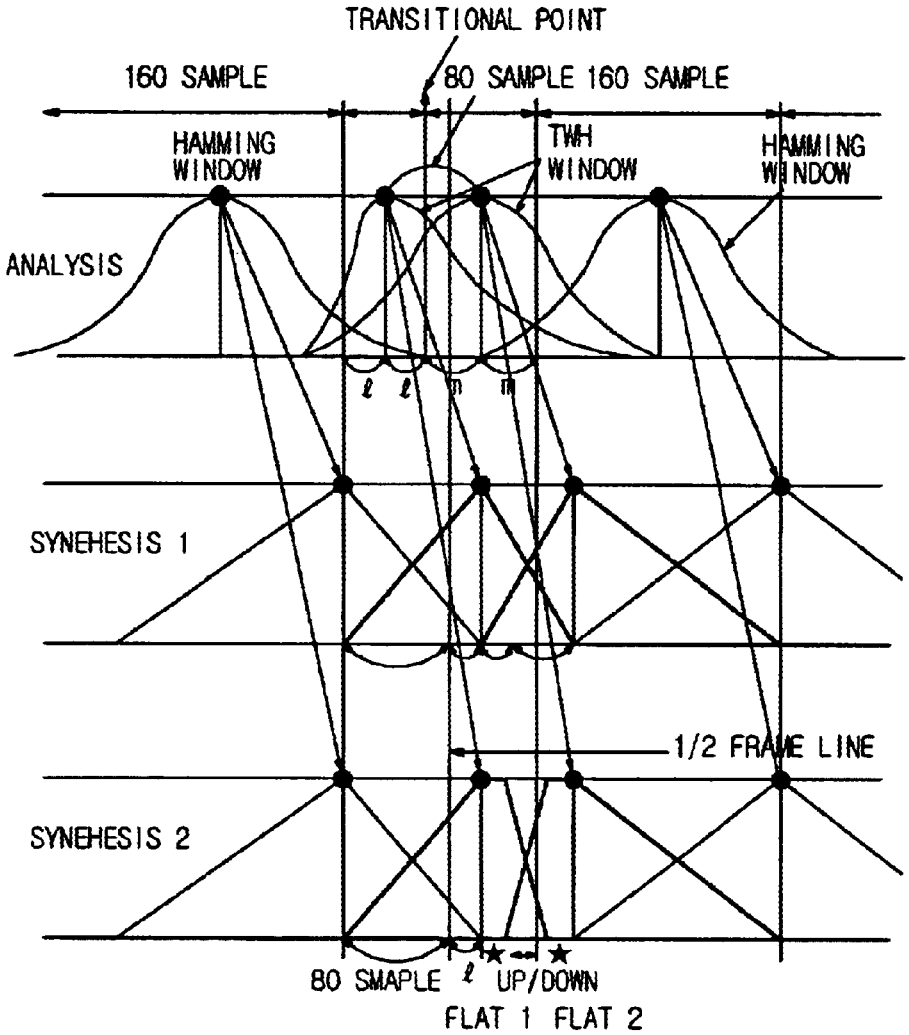
FIG. 5 is a drawing illustrating an executable example in which the block is divided into two.

In order to guarantee the continuity between frames, the start position defined as offset is defined. In the real case, by considering the offset section in which the pitch is varied fast, the start point is implemented while being separated into synthesis 1 and synthesis 2 as illustrated in FIG. 5.

The following describes the determination of the transitional analyzer, the detection of the transitional point, TWH window and the synthesis method in the transitional analyzer analysis/synthesis designed by using the harmonic speech coder.

In the case of applying general voiced/unvoiced sounds detection can be determined by the estimated correctness of the spectral magnitudes and the factors of the frequency balance value.

After deciding the voiced/unvoiced sound, the detection of the transitional analyzer is tried and the transitional mode has priority to the voiced sound mode. In the case of unvoiced mode, it is not decided as the transitional analyzer.

In order to measure the degree of abruptly varying energy of the left and right sides on the basis of arbitrary time of 160 samples, the detection of said transitional analyzer according to the present invention uses following Equation 5 to compute the energy ration value for the n time $E_{rate}(n)$.

$$E_{\min}(n) = \min\left[\sum_{i=0}^{P} s^2(n+i), \sum_{i=0}^{P} s^2(n-i)\right] \tag{5}$$

$$E_{\max}(n) = \max\left[\sum_{i=0}^{P} s^2(n+i), \sum_{i=0}^{P} s^2(n-i)\right]$$

$$E_{rate}(n) = \left[\frac{E_{\max} - E_{\min}}{E_{\max}}\right]^2$$

Where, P is pitch period, s(n) represents the speech signal after passing a DC removal filter configured to remove the DC-bias component present in the speech signal. The min (x,y) is the function selecting the smaller number out of x and y and the max(x,y) the function selecting the larger number out of x and y.

The P is used to reduce the influence of the peak value in the pitch period. Also in the real case, although the energy ratio of left/right is high, by considering the case that energy difference is not discriminated by man's perceptibility, if meeting two conditions as following Equation 6, decides as the transitional analyzer.

$$E_{min}(n) > T_1$$

$$E_{max}(n) - E_{min}(n) > T_2 \tag{6}$$

Where, $T_1$ and $T_2$ are empirical constant values. In the case of meeting above condition, the procedure for obtaining the transitional point is included and the time at which the $E_{rate}(n)$ within frame is the largest is parameterized as transitional point.

In a desirably executable example, 0.55 and $1.5\times10^6$ were used as said $T_1$ and $T_2$ values respectively. According to the research results of the inventors of the present invention, this detection method showed good performance especially in the detection of narrow block signal of voiced section.

In the real coding portion, about 32 samples of both sides out of 160 samples were excluded. The reason is that if the transitional point is partial to one side, even though covering asymmetric window, the number of samples used for analysis is so small that the distortion is occurred by the deficiency of representation. If the transitional analyzer is determined after detecting the transitional point by using left/right energy ratio, the transitional point is returned to 4 positions fitting to 2 bits, which are allocated for the quantization of the transitional point.

The position values of said transitional point used for the appropriate voice coder according to the present invention are defined as 32, 64, 96 and 128 on the basis of 160 samples and 80, 112, 144 and 176 on the basis of 256 analysis frame.

Each central value of two blocks divided into on the basis of the position of the transitional point becomes the central position of analysis and also in the case of window, the central position of the analysis must be changed to the central value of each block.

In a desirably executable example according to the present invention, a new window centered by the central value of each block is proposed in order to solve the adaptation problem for a variable central position.

The TWH window in which the peak value occurs in the central value is defined in the following Equation 7, $$\omega(c,n) = \begin{cases} \omega_h(c,n); & 0 \le c \le \frac{(N-1)}{2} \\ \omega_h(128-c, 128-n); & \frac{(N-1)}{2} \le c \le (N-1) \\ 0; & \text{otherwise} \end{cases} \tag{7}$$

$$\omega_h(c,n) = 0.54 - 0.46\cos\left(2\pi\frac{f_\omega(c,n)}{N-1}\right)$$

$$f_\omega(c,n) = \frac{N-1}{2\log\left(\frac{N-1-c}{c}\right)}\log\left(1 + \frac{N-1-2c}{c}n\right);\ c \le \frac{(N-1)}{2}$$

Where, c is the center of the block and N represents the number of samples of the analysis frame.

FIGS. 4A–4D illustrate the shape of the TWH window using the central values of two blocks according to the position value of each transitional point. The windowed samples of each block are used as the input value of harmonic analysis in order to obtain the pitch value and magnitude of each harmonic spectral. Herein, before being used as input of the harmonic analysis, the gain control equation of the following Equation 8 is used in order to adapt the energies of both blocks to the original signal.

$$G = K\sqrt{\left(\frac{\sum_{k=1}^{N} s(k)^2}{\sum_{k=1}^{N} s_\omega(k)^2}\frac{N}{n}\right)} \tag{8}$$

Where, s(k) is the input signal prior to window treatment, $s_w(k)$ represents the input signal, which is TWH window treated, and N, n and K represent the length of total frame, the length of the transitional analyzer and the mean energy of the window respectively.

In the case of applying the IFFT synthesis method described above to the time-separated coding according to the present invention, an additional method is needed to preserve the linear phase between frames. By referring to FIG. 5 the case is described.

Referring to FIG. 5, an executable example in which the block is divided into two is described. Accordingly, because the length of the block is variable, the phase matching procedure is needed. The phase can be simply fitted by applying different synthesis lengths of two blocks for the offset control process and the linear phase synthesis process in the IFFT synthesis process of the harmonics instead of the length of 160 samples.

As shown in FIG. 5, in the case of defining the position of the transitional point as 21, the synthesis center of the 1st block becomes "l" and the synthesis length becomes "80+l". Also, the synthesis length of the 2nd block becomes "l+m=80".

When the synthesis of the 2nd block is completed, the synthesis samples exceeding 160 samples are saved and the position of the synthesis start time is set as "l".

The general algorithm about this can be explained by dividing into the case of the transitional analyzer and the case of the non-transitional analyzer.

In the case of the non-transitional analyzer, the synthesis length becomes $L-st^{k-1}$ and the start position of the synthesis buffer becomes $st^{k-1}$ expressed clearly in the past frame. Herein, L means the frame length. Finally becomes $st^k$.

In the case of the transitional analyzer, passes the 1st section and the 2nd section, the synthesis length of the 1st section is $L/80+l-st^{k-1}$ and the start position of the synthesis buffer becomes $st^{k-1}$. The synthesis length of the 2nd section is L/2 and the start position of the synthesis buffer becomes 80+l. Finally, $st^k$ becomes l.

By performing synthesis through the existing IFFT synthesis method with the synthesis length and the value of the start position, the continuity of the waveform maintaining linear phase can be guaranteed without any additional phase accordance method.

Although, the present invention was described on the basis of preferably executable examples, these executable examples do not limit the present invention but exemplify. Also, it will be appreciated by those skilled in the art that changes and variations in the embodiments herein can be made without departing from the spirit and scope of the present invention as defined by the following claims and the equivalents thereof.

What we claim:

1. A time-separated speech coder for coding the transitional signal of voiced/unvoiced sound through harmonic speech coding, the time-separated speech coder comprises:

an excitation signal transitional analyzer analyzing means which comprises:

a transitional point detecting means for detecting a transitional point to notify the transitional analyzer of said transitional signal;

a harmonic excitation signal analyzing means including window means for extracting harmonic model parameter of each block by applying a Time Warp Hamming (TWH) window to a central point of each left/right block after dividing a Linear Prediction Coefficient (LPC) residual signal which is one of the inputted signals within the transitional analyzer centering said detected transitional point; and a harmonic excitation signal synthesizing means for adding said harmonic model parameter.

2. The time-separated speech coder according to claim 1, wherein said transitional point detecting means detects said transitional point by measuring abruptly varying degree of the energy ratio of left/right block after computing the left/right energy ratio value $E_{rate}(n)$ for certain time n.

3. The time-separated speech coder according to claim 2, wherein the computation of left/fight energy ratio value $E_{rate}(n)$ for said time n is comprised by using the following equation:

$$E_{\min}(n) = \min\left[\sum_{i=0}^{P} s^2(n+i), \sum_{i=0}^{P} s^2(n-i)\right]$$

$$E_{\max}(n) = \max\left[\sum_{i=0}^{P} s^2(n+i), \sum_{i=0}^{P} s^2(n-i)\right]$$

$$E_{rate}(n) = \left[\frac{E_{\max} - E_{\min}}{E_{\max}}\right]^2$$

where, P is the pitch period, s(n) represents the speech signal after passing a Direct Current removal filter, min(x,y) is the function selecting the smaller number out of x and y, and max(x,y) is the function selecting the larger number out of x and y.

4. The time-separated speech coder according to claim 1, wherein said TWH window ω is represented in the following equation:

$$\omega(c, n) = \begin{cases} \omega_h(c, n); & 0 \le c \le \frac{(N-1)}{2} \\ \omega_h(128-c, 128-n); & \frac{(N-1)}{2} \le c \le (N-1) \\ 0; & \text{otherwise} \end{cases}$$

$$\omega_h(c, n) = 0.54 - 0.46\cos\left(2\pi \frac{f_\omega(c, n)}{N-1}\right)$$

$$f_\omega(c, n) = \frac{N-1}{2\log\left(\frac{N-1-c}{c}\right)} \log\left(1 + \frac{N-1-2c}{c} n\right); \; c \le \frac{(N-1)}{2}$$

where, c is the center of the block, and N represents the number of samples of analysis frame.

5. The time-separated speech coder according to claim 1, wherein said window means adjust two blocks' energies to the original signal through gain control before using as input of harmonic analysis by applying the TWH window to said energies of left/right block.

6. The time-separated speech coder according to claim 5, wherein said gain control is performed through the following equation:

$$G = K\sqrt{\left(\frac{\sum_{k=1}^{N} s(k)^2}{\sum_{k=1}^{N} s_\omega(k)^2} \frac{N}{n}\right)}$$

where, s(k) is the input signal prior to window treatment, $s_w(k)$ represents the input signal which is TWH window treated and N, n, and K represent the length of total frame, the length of the transitional analyzer and the mean energy of the window, respectively.

7. The time-separated speech coder according to claim 1, wherein said harmonic excitation signal synthesizing means guarantees the linear phase of each frame by making the synthesis length and synthesis start position in synthesizing the extracted model parameter, (a) in the case of non-transitional analyzer, makes the synthesis length as "$L-st^{k-1}$", the synthesis buffer start position as "$st^{k-1}$" and finally "$st^k$" value as 0;

(b) in the case of transitional analyzer, divides into the first and the second section, and in the first section makes the synthesis length as "$L/80+l-st^{k-1}$" and synthesis buffer start position as "$st^{k-1}$" and in the second section makes the synthesis length as "L/2", the synthesis buffer start position as "80+l" and finally "$st^k$" value as l, wherein the transitional point, the synthesis length of each block and the frame length are defined as 2l, 160 samples and L, respectively.

8. A time-separated speech coding method for coding the transitional signal of voiced/unvoiced sound through harmonic speech coding, comprising the steps of:

a transitional point detecting step for detecting the transitional point of the transitional signal;

a window applying step for extracting harmonic model parameter of each block by applying TWH window to the central point of left/right block after dividing LPC residue signal out of inputted signals centering said transitional point; and a synthesis step for adding said harmonic model parameter.

9. The time-separated speech coder according to claim 8, wherein said synthesis step guarantees the linear phase of each frame by making the synthesis length and synthesis start position in order to use an Inverse Fast Fourier Transform (IFFT) synthesis algorithm, (a) in the case of non-transitional analyzer, makes the synthesis length as "$L-st^{k-1}$", the synthesis buffer start position as "$st^{k-1}$" and finally "$st^{k}$" value as 0;

(b) in the case of transitional analyzer, divides into the first and the second section, and in the first section makes the synthesis length as "$L/80+l-st^{k-1}$" and synthesis buffer start position as "$st^{k-1}$" and in the second section makes the synthesis length as "L/2", the synthesis buffer start position as "80+l" and finally "$st^{k}$" value as l, wherein the transitional point, the synthesis length of each block and the frame length are defined as 2l, 160 samples and L, respectively.

10. A time-separated speech coder for coding a transitional signal of voiced and unvoiced sound through harmonic speech coding, the time-separated speech coder comprising:

an excitation signal transitional analyzer, comprising:

a transitional point detector configured to detect a transitional point of the transitional signal by measuring abruptly varying degrees of the energy ratio of a left and right signal block after computing a left and right energy ratio value $E_{rate}(n)$ for a time n, a computation using the following equation:

$$E_{\min}(n) = \min\left[\sum_{i=0}^{P} s^2(n+i), \sum_{i=0}^{P} s^2(n-i)\right]$$

$$E_{\max}(n) = \max\left[\sum_{i=0}^{P} s^2(n+i), \sum_{i=0}^{P} s^2(n-i)\right]$$

$$E_{rate}(n) = \left[\frac{E_{\max} - E_{\min}}{E_{\max}}\right]^2$$

where, P is the pitch period, s(n) represents the speech signal after passing a Direct Current removal filter, min(x,y) is the function selecting the smaller number out of x and y, and max(x,y) is the function selecting the larger number out of x and y;

a harmonic excitation signal analyzer for extracting a harmonic model parameter of each left and right block; and a harmonic excitation signal synthesizer for adding the harmonic model parameter.

* * * * *